United States Patent [19]

Playe

[11] Patent Number: 4,831,488

[45] Date of Patent: May 16, 1989

[54] DEVICE FOR REMOVING ELECTROSTATIC CHARGE

[75] Inventor: Patrice Playe, Houilles, France

[73] Assignee: La Telephonie Industrielle et Commerciale Telic Alcatel, Strasbourg, France

[21] Appl. No.: 21,371

[22] Filed: Mar. 3, 1987

Related U.S. Application Data

[63] Continuation at PCT FR86/00233 filed Jul. 1, 1986, abandoned.

[30] Foreign Application Priority Data

Jul. 3, 1985 [FR] France ..... 85 10168

[51] Int. Cl.[4] ..... H04F 3/02

[52] U.S. Cl. ..... 361/221

[58] Field of Search ..... 361/212, 214, 220, 221, 361/222

[56] References Cited

U.S. PATENT DOCUMENTS 3,671,806 6/1972 Whitmore et al. ..... 361/212

4,363,070 12/1982 Kisler ..... 361/212

4,494,166 1/1985 Billings et al. ..... 361/214

FOREIGN PATENT DOCUMENTS 2524390 10/1983 France .

*Primary Examiner*—L. T. Hix

*Assistant Examiner*—Brian W. Brown

*Attorney, Agent, or Firm*—Sughrue, Mion, Zinn, Macpeak, and Seas

[57] ABSTRACT

A charge-removing device intended to eliminate electrostatic charge from a thin dielectric strip, and in particular a rolled dielectric film. The device comprises at least two electrically conductive rolls (4,5) forming electrodes which are subjected to a potential difference by a low frequency high tension source. These rolls are parallel and come into transverse contact at the same time with respective faces of a thin strip dielectric (1) passing therebetween. The invention is applicable, in particular, to electrostatic type printers.

2 Claims, 3 Drawing Sheets

DEVICE FOR REMOVING ELECTROSTATIC CHARGE

CROSS REFERENCE TO RELATED APPLICATIONS

This application is a continuation of PCT Application No. PCT/FR86/00233 having international filing date July 1, 1986, and now abandoned.

BACKGROUND OF THE INVENTION

The present invention relates to a charge-removing device for eliminating the electrostatic charge liable to be carried on thin dielectrics strip, in particular those of the rolled film type which are used as image transfer ribbons in electrostatic printers.

These dielectric strips have the property of being easily electrified when they come into contact with other materials or with themselves during forming.

Such electrification sometimes generates large parasitic electric fields capable of disturbing the operation of the apparatus using the strips.

Parasitic electric fields created in this way originate from the electrostatic charges carried on the surface of the dielectric in active dipoles which are created by the molecular chains of the materials constituting the dielectric, and they also originate to a smaller extent from surface doublets.

In some applications, and in particular in electrostatic printing, means are thus provided for eliminating the electrostatic charges carried by the thin dielectric strip before use, i.e. while it is being unwound if it is in the form of a film stored on a reel.

The commonest method of eliminating electrostatic charge consists in rubbing a suitably connected conductive assembly of the brush or ruffle type over the dielectric surface to be discharged. Such conductive assemblies are suitable for preventing the electric field from reaching too high a value, but they are not capable of removing it completely.

Another known method consists in holding a small diameter metal wire taut and parallel to the surface of the dielectric and in subjecting it to high voltage AC which ionizes the ambient air to create a flow of alternatively positive and then negative ions which compensate the surface charge on one of the two faces of the dielectric by electrostatic attraction.

However, this method is difficult to implement since the electrode-forming wire must be free from surface state defects and free of impurities, and must be accurately placed relative to the film which is conventionally the moving part, since otherwise charge is not removed uniformly.

Consequently, the present invention proposes a charge-removing device for eliminating electrostatic charge on a thin dielectric strip.

SUMMARY OF THE INVENTION

According to a characteristic of the invention, the charge-removing device comprises at least two electrostatically conductive rollers constituting electrodes which are subjected to a potential difference by a high alternating voltage and which are parallel in such a manner as to make transverse contact at the same level on respective faces of the thin strip of dielectric passing between.

BRIEF DESCRIPTION OF THE DRAWINGS

The invention, its characteristics and its advantages are described below with reference to the drawings, wherein.

DETAILED DESCRIPTION OF THE INVENTION

Figure 1:
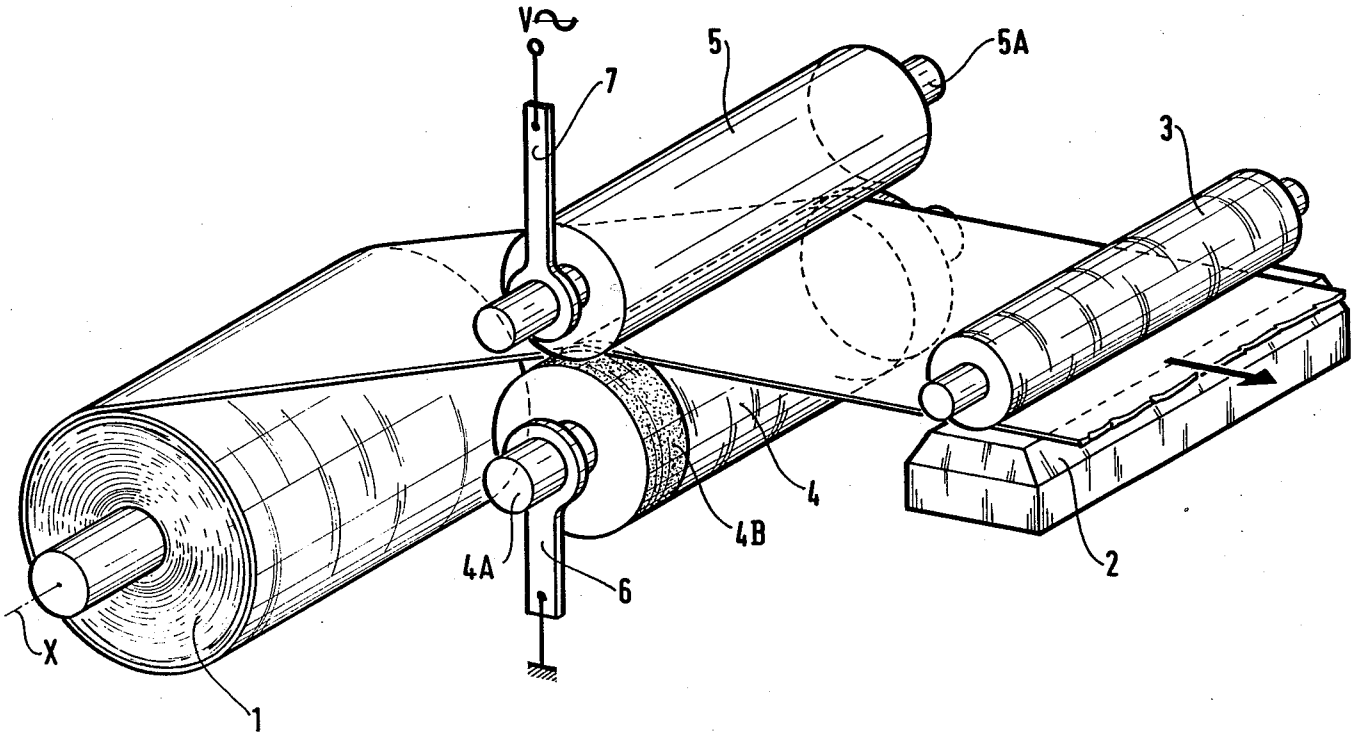
FIG. 1 shows a device in accordance with the invention for removing electrostatic charge, said device being disposed between a printing arrangement and a roll of dielectric, with the thin strip passing through the device.

The device for removing electrostatic charge shown in FIG. 1 is intended to eliminate any trace of electrostatic charge from a strip of conventional dielectric material 1 being unreeled for use as a temporary recording medium by an indirect electrostatic printer.

The indirect electrostatic printer may, for example, be of the kind described in French Pat. No. 2,524,390, and the strip of dielectric material is intended to serve as an intermediate medium on which an electrostatic latent image which is developed and then transferred onto a final medium (generally paper) on which the image is then fixed.

The removing device is placed between the roll of dielectric material 1 and a latent image print station combining a print head 2 and a counter-electrode in the form of a roll 3.

The print head 2 is conventionally provided with a plurality of individual electrodes arranged in one or more lines or in matrix form and which are disposed facing the counter-electrode roll 3. The strip of dielectric material 1 runs between the print head 2 and the counter-electrode 3 to receive an electrostatic latent image on that one of its faces which comes into contact with the print head, when said print head receives printing control signals from a circuit which is not shown herein.

The charge-removing device in accordance with the invention is thus placed, in the example shown, immediately upstream from the print head 2 in such a manner as to eliminate all parasitic electric charge which may be found on the strip of dielectric material 1 prior to printing.

The charge-removing device comprises at least two conductive rolls 4 and 5 which constitute electrodes, which are disposed in parallel, and between which the strip of dielectric material 1 passes from the reel towards the print head 2.

The roll 4 is constituted by a cylinder of hard and highly conductive material, for example a metal, and it is electrically connected to ground via at least one electrical connector arrangement 6 placed at one end of a shaft 4A carrying the roll 4. The connector arrangement may comprise a conventional circuit (not shown) of the type comprising a fixed brush and a rotary slip ring on the end of the shaft placed in the proximity of a shaft-supporting bearing.

The roll 5 is constituted by an electrically conductive cylinder, for example made of a flexible material of the elastomer or silicon type with a fill of conductive particles. This cylinder is supported by a metal shaft 5A which is mounted to idle and which is connected to an alternating potential V via a second electrical connector arrangement 7.

The two rolls 4 and 5 are pressed against each other along a generator line of each of their respective cylinder shapes.

A resilient mounting using a spring or compressed material provides the necessary pressure in an arrangement which is conventional for the purpose and is not described in greater detail insofar as it has no direct relationship with the invention.

The alternating potential V is provided by a conventional high tension source (not shown) which provides, for example, a signal which is at least approximately sinusoidal, having a frequency lying in the range 1 kHz to 150 kHz, and with the applied potential difference being about 1500 V peak-to-peak.

Ion discharge thus occurs between the roll 5 and the face of the dielectric material strip 1 against which the roll is pressed.

The strip of dielectric material 1 which passes between the rolls 4 and 5 is normally interposed between their respective conductive portions so as to avoid direct contact between said parts, and the active width of the rolls is thus generally limited so as to ensure that it is always less than the width of the strip. To this end, one of the rolls may optionally be narrower than the other; alternatively, insulating rings may be mounted at the ends of the rolls 4 and 5 so that the margins of the strip press against the rings and prevent the conductive portions from coming into contact in the event of the strip shifting sideways a small distance as it moves.

Figure 2:
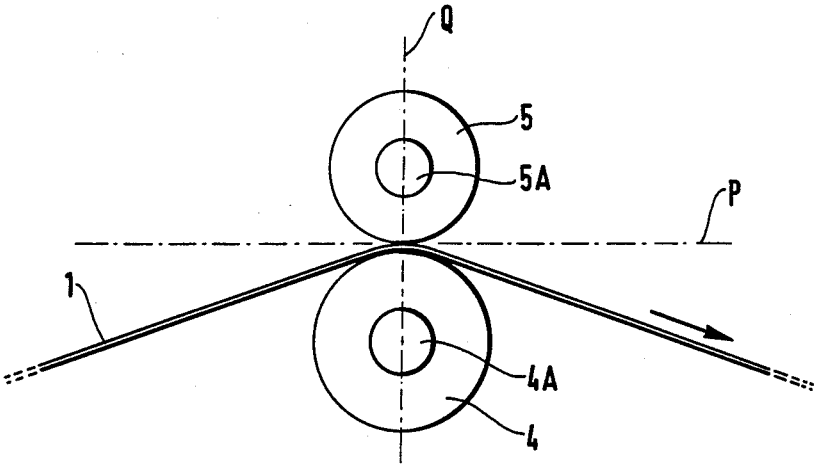
FIG. 2 is a diagrammatic view of the device shown in FIG. 1.

Preferably, the strip of dielectric material 1 which is pressed by one of the rolls against the other under the action of a conventional mechanism (not shown), penetrates between and/or leaves the rolls 4 and 5 at an inclination which may be more or less accentuated relative to the plane P which passes between the rolls 4 and 5 and which is perpendicular to the plane passing through the axes of the shafts 4A and 5A of the rolls (as shown in FIG. 2). As a result, the strip 1 comes into contact with each of the rolls over a portion thereof whose size varies depending on the inclination. In the embodiment shown, the strip both arrives and leaves below the plane P passing between the rolls 4 and 5 and perpendicular to the plane Q passing through the axes of the shafts 4A and 5A such that the strip is applied against an area of the roll 4 which is greater than the area of the roll 5 against which it is also pressed. In the example, the area is distributed over the roll 4 on either side of the plane passing through the axes of the shafts 4A and 5A, thereby obtaining two ion discharge zones in the air situated respectively on either side of said plane, between the roll 5 and the strip of dielectric material 1.

Figure 4:
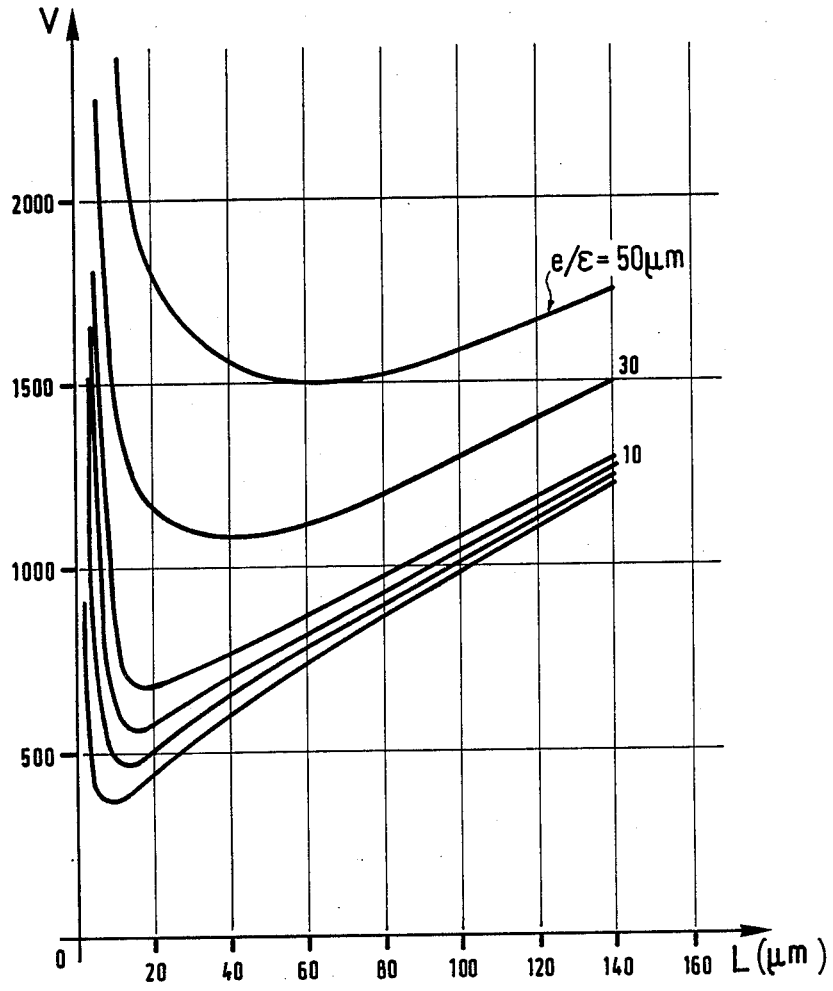
FIG. 4 is a graph defining the necessary conditions for ionization to remove electrostatic charge.

FIG. 4 shows the ionization voltage V which is required in air at ambient pressure and temperature as a function of the distance between the electrode at the ionization potential and the face of the film facing said electrode, together with the thickness of the film e and its dielectric constant . The figure shows that ion discharge takes place over a defined gap of distance L and consequently that electrostatic charges carried by the strip are eliminated, at least from the face oriented towards the roll 5.

In order to improve the elimination of electrostatic charge, if need be, the other face of the strip of dielectric material 1 may also be processed by passing the strip of material so that its other face is in turn oriented towards a roll raised to the ionization potential and against which it is pressed by a roll connected to ground.

This may be obtained, for example, by means of a second set of two rolls disposed on either side of the strip of dielectric material and with their positions inverted relative to the rolls 4 and 5.

In a variant, the roll 5 which is raised to the ionization potential V may be associated with two identical conductive parallel rolls such as the roll 4 and disposed on either side of the roll 5 so as to enable a single movement to successively pass each of the two faces of the strip of dielectric material 1 against the roll 5, between the roll 5 and another roll connected to ground for each face of the strip, said strip then forming a loop (not shown).

Figure 3:
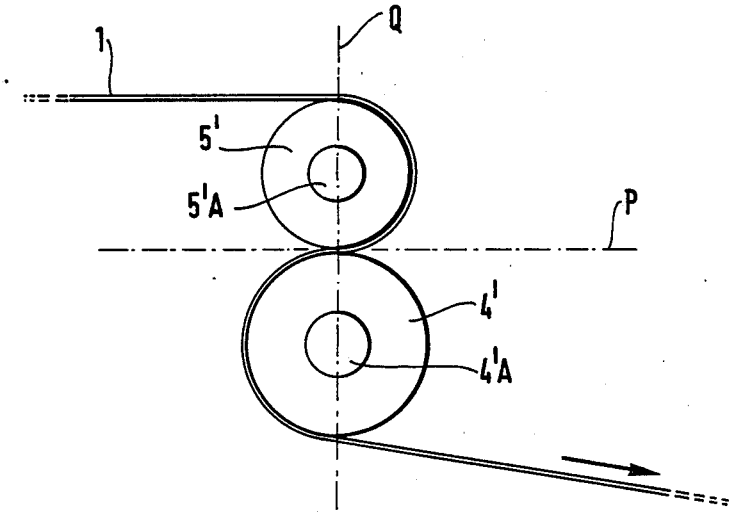
FIG. 3 is a diagrammatic view of a variant device in accordance with the invention for removing electrostatic charge.

In another variant, shown in FIG. 3, electrostatic charges are removed from both faces of a strip of dielectric material 1 by means of two rolls 4' and 5' which differ from the embodiment shown in FIG. 1 solely by their disposition.

In order to do this, the strip is inserted between and leaves the rolls 4' and 5' on opposite sides of the plane P which passes between these rolls and which is perpendicular to the plane Q passing through the axes of the shafts 4'A and 5'A of said rolls, so that the strip is applied over a relatively large area of each of the rolls as can be seen in FIG. 3 and so that two comparable zones of ion discharge in air are created, one of the zones being between the roll 5' and the strip before it passes between the rolls 4' and 5', and the other being between the roll 4' and the strip 1 after it has passed between the rolls. Each of these zones operates on a different face of the strip.

The rolls provided in this variant and also in the example shown in FIG. 1 are conventionally positioned by bearings mounted in a frame in dispositions which are well known in the art and which are thus neither shown nor described herein.

We claim:

1. A device for removing electrostatic charge from both faces of a thin dielectric strip, in particular of the roll dielectric film type, said device comprising at least two electrically-conductive parallel rolls constituting electrodes, said rolls being subjected to a low-frequency high-tension AC potential difference and making transverse contact at the same time with respective faces of the thin dielectric strip passing therebetween and sandwiched therebetween, wherein the arrival and exit of said strip between said rolls occurs on opposite sides of a plane which passes between the axes of the two rolls and is perpendicular to a plane defined by the axes of the two parallel rolls, to thereby create a first zone of ion discharge between one face of the thin dielectric strip and one of the two rolls and a second zone of ion discharge between the other face of the thin dielectric strip and the other of said two rolls, to successively eliminate electrostatic charges from both sides of the strip when it passes once through the rolls.

2. A device for removing electrostatic charges according to claim 1, wherein said low-frequency high-tension AC potential difference is an alternating potential difference having a value close to 1500 V at a frequency line in the range of 1 to 150 kHz.

* * * * *